US006648737B2

(12) United States Patent
Deware et al.

(10) Patent No.: US 6,648,737 B2
(45) **Date of Patent: *Nov. 18, 2003**

(54) CONTOUR SANDING APPARATUS AND KIT

(76) Inventors: William R. Deware, 4 South Rd., Belmont, NH (US) 03220; William L. Andrews, P.O. Box 1695, Rochester, NH (US) 03862

( * ) Notice: Subject to any disclaimer, the term of this patent is extended or adjusted under 35 U.S.C. 154(b) by 233 days.

This patent is subject to a terminal disclaimer.

(21) Appl. No.: 09/814,146

(22) Filed: Mar. 21, 2001

(65) Prior Publication Data

US 2003/0003854 A1 Jan. 2, 2003

Related U.S. Application Data

(63) Continuation-in-part of application No. 09/589,507, filed on Jun. 7, 2000, now Pat. No. 6,503,128.

(51) Int. Cl.[7] ..... B24B 1/00; B24B 21/02

(52) U.S. Cl. ..... 451/59; 457/49; 457/297; 457/311; 457/348; 457/355

(58) Field of Search ..... 451/49, 50, 59, 451/297, 348, 311, 355, 303

(56) References Cited

U.S. PATENT DOCUMENTS 2,261,244 A * 11/1941 Fowler ..... 451/303
2,296,990 A * 9/1942 Fowler ..... 451/303
3,093,170 A * 6/1963 Thayer ..... 144/208.1
3,283,447 A * 11/1966 Creftsinger ..... 451/303
3,566,549 A * 3/1971 Lasko et al. ..... 451/355
4,031,668 A * 6/1977 Lasko et al. ..... 451/303
4,084,356 A * 4/1978 Brears ..... 451/59
5,031,362 A * 7/1991 Reiling et al. ..... 451/355
5,643,062 A * 7/1997 Joseph et al. ..... 451/355
6,220,946 B1 * 4/2001 Arnold ..... 451/307
6,379,232 B1 * 4/2002 D'Aquila ..... 451/303
6,425,811 B1 * 7/2002 Marks, Jr. ..... 451/303
6,503,128 B1 * 1/2003 Deware et al. ..... 451/59

* cited by examiner

*Primary Examiner*—George Nguyen
(74) *Attorney, Agent, or Firm*—Michael J. Persson; Lawson & Persson, P.C.

(57) ABSTRACT

A contour sanding apparatus for driving a sanding belt, the apparatus includes a body and a drive pulley rotatably attached to the body, the drive pulley comprising a drive-axle dimensioned for attachment to a source of rotation. A primary arm is fixedly attached to the body and includes an end portion to which a primary idler pulley is rotatably attached. A secondary arm is also provided. The secondary arm includes a first end portion to which a secondary idler pulley is rotatably attached and may include tensioning means for maintaining the sanding belt in tension. The secondary idler pulley is disposed in relation to the primary idler pulley such that the sanding belt forms a sanding portion between the primary idler pulley and the secondary idler pulley. The sanding belt is dimensioned for disposal about the drive pulley, the primary idler pulley, and the secondary idler pulley such that the a sanding portion of the sanding belt, disposed between the primary idler pulley and the secondary idler pulley, may be made to conform to a plurality of contours.

28 Claims, 14 Drawing Sheets

CONTOUR SANDING APPARATUS AND KIT

REFERENCE TO RELATED APPLICATIONS

This application is a Continuation-In-Part of U.S. patent application Ser. No. 09/589,507, filed on Jun. 7, 2000, U.S. Pat. No. 6,503,128.

BACKGROUND OF THE INVENTION

I. Field of the Invention

The present invention relates to tools for sanding or grinding. More particularly, the present invention relates to a contour sanding apparatus for use with hand-held power tools, enabling a user to abrade contoured surfaces.

II. Description of Related Art

Belt sanders have been used for abrading or sanding many different types of surfaces. Free standing or bench mounted belt sanders typically have three rollers, which control the travel of the abrading belt. One of these three rollers will be driven and the other two rollers remain idle or free spinning. Normally the work area of these belt sanders is in between the two idler rollers.

Most of today's bench top or pedestal type belt sanders will incorporate a rigid planar work plate that is secured and located within this work area. The abrading loop or belt will travel in front of the work plate, which is used as a support on the backside of the sanding belt while abrading the workpiece on the front side of the sanding belt. As the work plate is a rigid planar plate, these belt sanders are adapted primarily for abrading flat or straight surfaces and, consequently, cannot effectively sand contoured surfaces.

Power sanders having contouring capability are currently available. However, these are more costly and are generally limited to use on a specific contour. Accordingly, some of today's contour abrading is still being done by means of time consuming and tiresome efforts of physically sanding by hand.

A number of patents are directed to power sanding of contours. For example, U.S. Pat. No. 6,116,999, discloses a sander with the capability of sanding a bullnose concave surface by using sheets of abrasive materials, clamped in accordance with a flexible pad. Through capable of abrading a concave workpiece, it is limited to only that concave surface.

U.S. Pat. No. 5,725,423, discloses a back-up pad provided for supporting an abrasive article during abrading. Though capable of abrading some contours, this method is limited to abrading only slights contours.

U.S. Pat. No. 5,662,519, discloses a contour sander designed for sanding the details and curves of automobile body panels. This sander is limited to manual use and may not be adapted for use on a power sander.

U.S. Pat. No. 5,700,187, discloses a flexible device for holding abrasive materials, which can be adjusted to a variety of shapes. Though capable of conforming to a variety of curved shapes, the device has to be manually adjusted to each shape separately.

U.S. Pat. No. 3,956,858, discloses a flexible hand held abrading tool, which can easily conform to curves and contours. However, this is also limited to a manually operated hand held tool and not for use on power sanders.

In addition to traditional belt sanders, a number of hand held attachments directed at sanding and grinding have been introduced to the market. Typically, these attachments are mechanically coupled to the power tool at the site where a standard attachment, such as a drill-bit or sanding-wheel is otherwise placed. In spite of the advantages that these add-on devices may provide, they have not adequately addressed the problems associated with grinding or sanding surfaces intended to be non-flat. This is because these existing devices present either a flat or fixed-radius surface as a backing for the grind/sanding belt, which is a serious limitation for ornate work pieces incorporating curved portions. As a consequence, portions of such complex and ornate work-pieces tend to be either over-worked or under-worked during the finishing process.

A number of patents have been directed to hand held sanding attachments. For example, U.S. Pat. No. 4,551,951, discloses a detachable portable continuous-belt driving head for use in conjunction with an air driven rotatable spindle. By wrapping a sanding belt around the work-piece, this device can be used to sand or grind a significant portion of the circular contour of a cylindrical work-piece such as a pipe. However, wrapping such a belt around an uninterrupted span of pipe requires that the belt be 'seamed,' that is that it has seam where it can be opened and then rejoined. In other words, before this device can be used on a pipe, the ends of the grinding belt must be separated at the seam, the belt must be wrapped around the pipe, and the ends o the belt must be rejoined. This process is time consuming. Furthermore, the use of seam-containing grinding belts can be hazardous, since they are vulnerable to operator error in connecting and disconnecting the belt that can lead to the belt flying off the rollers, causing injury or damage.

U.S. Pat. Nos. 4,858,390 and 5,031,362, disclose similar endless-belt grinding attachments for use in conjunction with typical hand-held electric or pneumatic power drills. Both of these devices have a drive pulley, driven by the output of a power tool, and in idler-pulley disposed at the end, distal to the drive pulley, of an arm member. In use, a grinding belt is mounted on these pulleys. Because the grinding belt so mounted conforms to a single longitudinal axis these devices are limited to relatively small angles of contact when used with work pieces having curved contours, such as pipes or toroidal shapes. Consequently, it is difficult to use either of these devices to satisfactorily grind such curved surfaces.

U.S. Pat. No. 4,578,906 discloses another device using an endless grinding belt. This device is similar to those of U.S. Pat. Nos. 4,858,390 and 5,031,362 in that it has two pulleys, one being a drive-pulley. These pulleys are mounted at the ends of a longitudinal arm-member. An endless grinding belt fits over the pulleys and is stretched to an essentially flat configuration, so that it presents a flat grinding surface to the work piece. A spring is mounted coaxially with the arm-member and is used as a bias means for keeping the belt under tension and thus flat. However, this device has the same limitations as those described above.

Therefore, there is a need for a contour sanding device for use with standard sanding belts, which can work the surface of a variety of complex, ornate shapes, and can provide proper backing for a variety of contours or flat surfaces of a work-piece.

SUMMARY OF THE INVENTION

The present invention is a contour sanding apparatus for driving a sanding belt. For purposes of this application, the term sanding belt means an abrasive belt, such as those manufactured of sandpaper, steel wool, SCOTCHBRITEO®, or any other art recognized abrasive belts.

In one embodiment of the invention, the apparatus includes a body and a drive pulley rotatably attached to the body, the drive pulley comprising a drive-axle dimensioned for attachment to a source of rotation. A primary arm is fixedly attached to the body and includes an end portion to which a primary idler pulley is rotatably attached. A secondary arm is also provided. The secondary arm includes tensioning means for maintaining the sanding belt in tension, and a first end portion to which a secondary idler pulley is rotatably attached. The secondary idler pulley is disposed in relation to the primary idler pulley such that the sanding belt forms a sanding portion between the primary idler pulley and the secondary idler pulley. The sanding belt is dimensioned for disposal about the drive pulley, the primary idler pulley, and the secondary idler pulley such that the a sanding portion of the sanding belt, disposed between the primary idler pulley and the secondary idler pulley, may be made to conform to a plurality of contours.

In the preferred embodiment of the invention, the secondary arm extends from, and is pivotally attached to, the primary arm via a second end portion, which is disposed within a central slot in the central portion of the primary arm. The preferred secondary arm includes a non-slidable section that includes the second end portion, and a slidable section that includes the secondary idler pulley. It is preferred that a sleeve be slidably disposed about the non-slidable section such that the sleeve and the slidable section may slide along the non-slidable section when acted upon by the axial force exerted by the tensioning means. The preferred tensioning means is a spring disposed between the slidable section and the non-slidable section such that the spring exerts a axial force upon the slidable section relative to the non-slidable section.

In some alternative embodiments of the invention, the tensioning means is a fluid cylinder having a non-slidable section that includes the second end portion, and a slidable section that includes the secondary idler pulley. In these embodiments, the fluid cylinder includes a connection for pressurizing fluid within the fluid cylinder such that an axial force is exerted upon the slidable section relative to the non-slidable section. In other embodiments, the sleeve is eliminated and the slidable portion is dimensioned to slide along the non-slidable portion. In still other embodiments of the invention, the tensioning means of the secondary arm is eliminated and the tension on the sanding belt is adjusted by adjusting the location of the drive pulley for a desired profile or by utilizing an elastic sanding belt, such as to described in pending U.S. Application No. 19/519,086, filed by the present inventors on Mar. 6, 2000, which is incorporated herein by reference.

The preferred embodiment also includes a retainment-arm to which a retainment-pulley is mounted. The preferred retainment-arm is pivotally connected to the primary arm and disposed such that the retainment pulley contacts the sanding belt and directs it through a channel in the body. In some embodiments of the invention, one or more additional retainment pulleys are disposed at other locations about the apparatus to further guide the sanding belt. In still others, the retainment pulley is eliminated. In these embodiments, the body is either eliminated or is dimensioned to avoid contact with the rotating sanding belt.

The preferred retainment-arm, primary idler pulley, secondary idler pulley and drive pulley all include a drive layer manufactured of a flexible and substantially resilient material, such as rubber. This resilient material is preferred as it counteracts variations in belt tension and allows non-standard sanding belts, such as belts made of a material of the type sold by the Minnesota Mining and Manufacturing Company of St. Paul, Minn. under the trademark SCOTCH-BRITE®.

The preferred embodiment of the invention also includes support attachments that may be disposed between the primary arm and secondary arm to provide support to the sanding portion of the sanding belt when contoured surfaces are sanded. In one preferred embodiment, the apparatus is sold in kit form along with a variety of support attachments; preferably including at least one flex plate attachment and at least one support shelf. In such an embodiments, a wider range of contours may be sanded than is possible by utilizing the apparatus alone.

The preferred flex plate attachment is disposed between, and attached to, the primary arm and the secondary arm proximate to the primary idler pulley and the secondary idler pulley. The flex plate attachment includes a lower support area, an upper support area, and a flexible work area that extends between the lower support area and the upper support area. The length of the flexible work area may be varied to allow plurality of arcs to be formed, with short work areas allowing the user to sand small diameter profiles and long work areas allowing large diameter profiles to be sanded. Accordingly, it is preferred that the kit includes flex plate attachments having flexible work areas of varying lengths.

The flex plate attachment may be manufactured of any material that is flexible enough to form a plurality of arcs without breaking or plastically deforming. The preferred materials for the flex plate attachment are polycarbonate and spring steel, which are preferred for light duty and heavy duty applications respectively. However, hard rubber or other spring metals are utilized in other embodiments. In some embodiments, the flex plate attachment is coated with a wear resistant coating, such a polytetraflouroethene.

The preferred support shelf is substantially rigid and includes a rigid work area that is dimensioned to allow the sanding belt to conform to a desired contour. The preferred rigid work area is substantially planar and is utilized to provide support during the sanding of flat surfaces. However, it is recognized that a variety of rigid work areas, such as concave and convex surfaces, may be formed into the support shelf, allowing the apparatus to sand a particular contour.

In the preferred embodiment, a support attachment is attached to the primary arm and secondary arm via a pair of mounting details, with the lower mounting detail being attached to the primary arm and the upper mounting detail being attached to the secondary arm. A variety of mounting details may be utilized, although the preferred embodiment includes one pivotal snapping detail and one pivotal pinning detail. These details are preferred as they allow the support attachment to be retained upon one of the arms when it is disengaged, allowing the user to avoid removal of the attachment when no support attachment is desired, while allowing for a quick engagement when such an attachment is desired.

The preferred embodiment also includes a locking means for securing the secondary arm in-a desired position relative to the primary arm. Such a locking means allows distance between the arms, and hence the length of the sanding portion of the sanding belt, to be varied. In embodiments utilizing a flex plate attachment, the locking means may be utilized to lock the flex plate attachment into place once it has been flexed to a desired profile.

In the preferred embodiment, the source of rotation for the contour sanding attachment is a separate tool, such as a hand held drill, grinder or the like. In these embodiments, it is understood that the contour sanding apparatus will be sold as an attachment for use with an existing source of rotation and, therefore, will utilize drive axles dimensioned for attachment thereto. Some embodiments of the axles include a smooth or knurled shaft that is dimensioned for gripping by a chuck of a drill or roto-tool. Others, such as those adapted for attachment to grinders, include counter-threaded screw type attachments. In some alternative embodiments, the contour sanding apparatus includes an integral source of rotation. In such embodiments, the drive axle of the drive pulley may be formed integral to the source of rotation, rather than being attached to it.

Therefore, it is an aspect of the invention to provide a contour sanding apparatus that may be adapted for use as an attachment to existing belt sanders and hand held power tools, or as a stand alone apparatus including a source of rotation.

It is a further aspect of the invention to provide a contour sanding apparatus that may include a plurality of support attachments to support the sanding belt so as to follow a desired contour.

It is a further aspect of the invention to provide a contour sanding apparatus that will allow the sander to abrade a variety of contoured surfaces.

It is a further aspect of the invention to provide a contour sanding apparatus that will be safe, easy to use and affordable for consumers.

It is a further aspect of the invention to provide a contour sanding apparatus that may include a flex plate attachment that enables it to sand either flat or contoured surfaces.

It is a further aspect of the invention to provide a contour sanding attachment that may be utilized with a polishing sanding belt, such as a SCOTCHBRITE® belt.

It is a further aspect of the invention to provide a contour sanding attachment that may be utilized with an elastic sanding belt.

It is a still further aspect of the invention to provide a flex plate attachment for a contour sanding apparatus that aids in the sanding of a variety of contours.

These aspects of the invention are not meant to be exclusive and other features, aspects, and advantages of the present invention will be readily apparent to those of ordinary skill in the art when read in conjunction with the following description, appended claims and accompanying drawings.

BRIEF DESCRIPTION OF THE DRAWINGS

FIG. 2 is a side view of the preferred embodiment of the contour sanding apparatus of the present invention, in which the primary arm and the secondary arm are spread apart, with a rigid support shelf deployed in between.

DETAILED DESCRIPTION OF INVENTION

Figure 1:
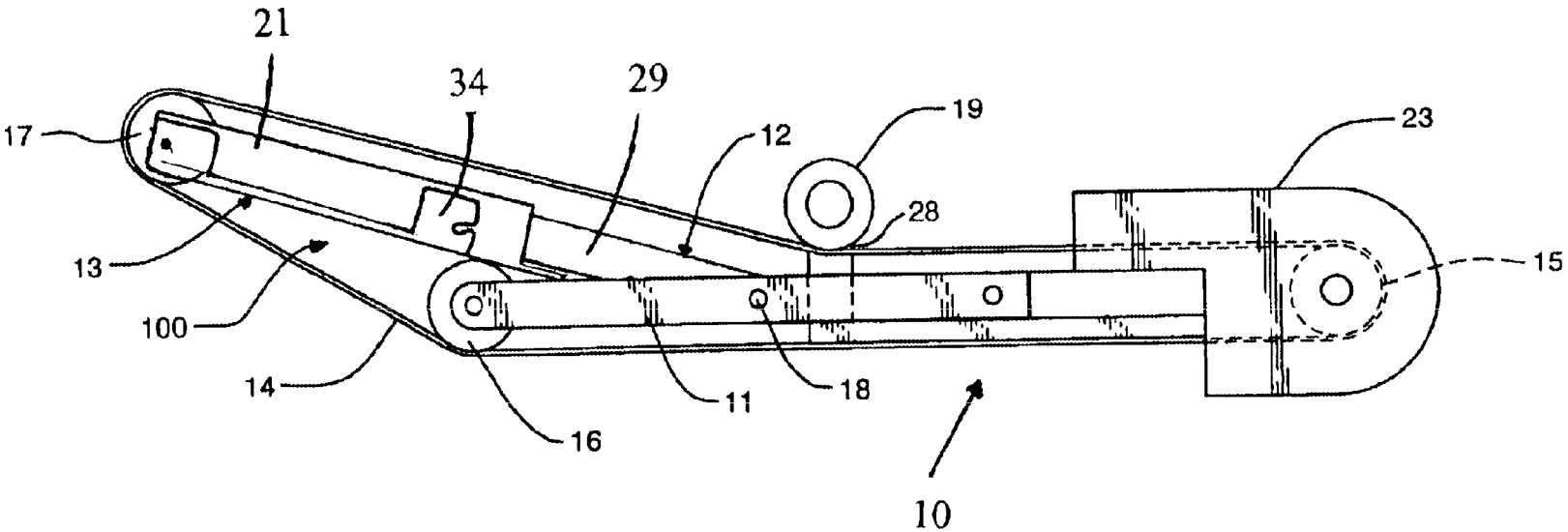
FIG. 1 is a side view of the preferred embodiment of the contour sanding apparatus of the present invention showing a flex plate attachment in an unengaged position.
Figure 2:
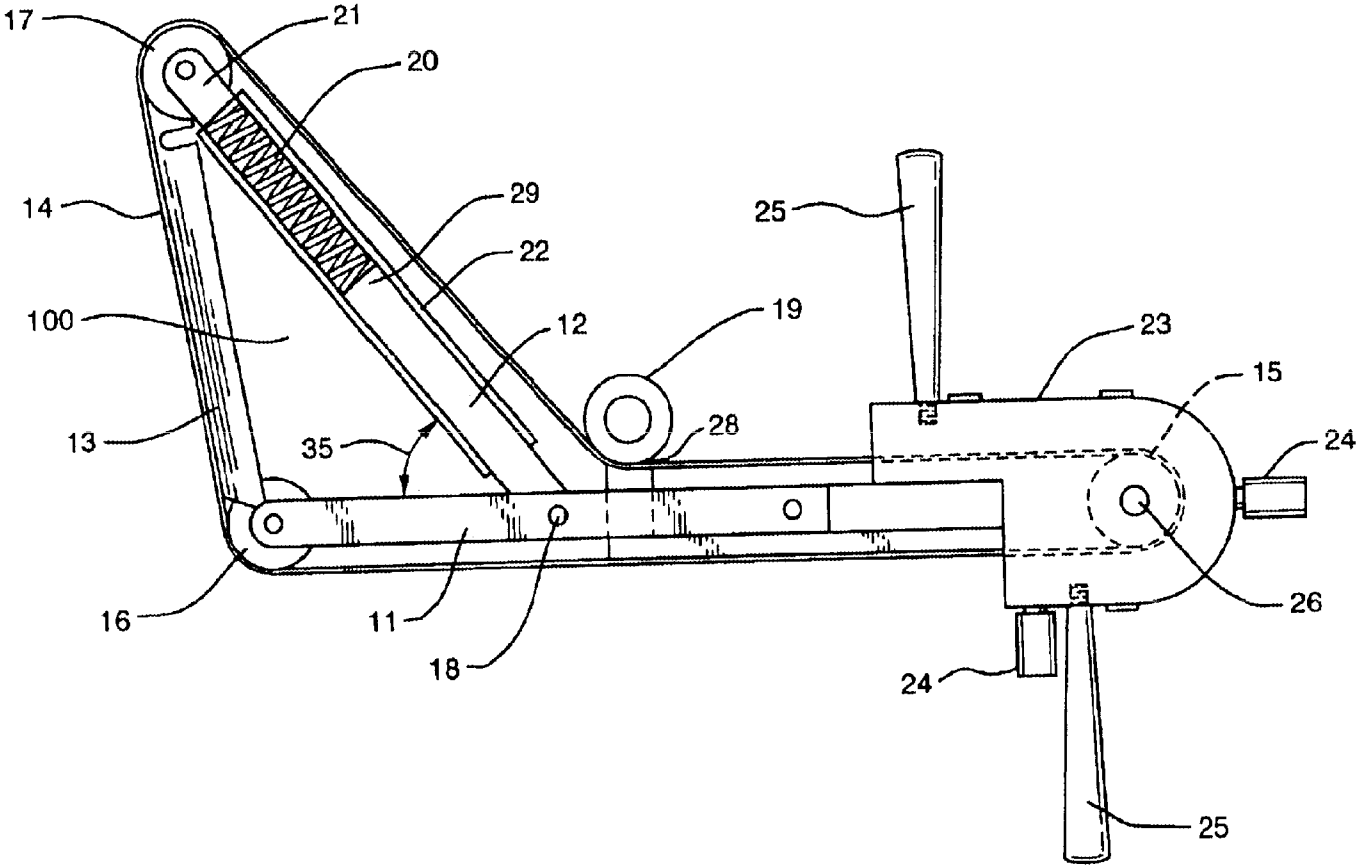
Figure 3:
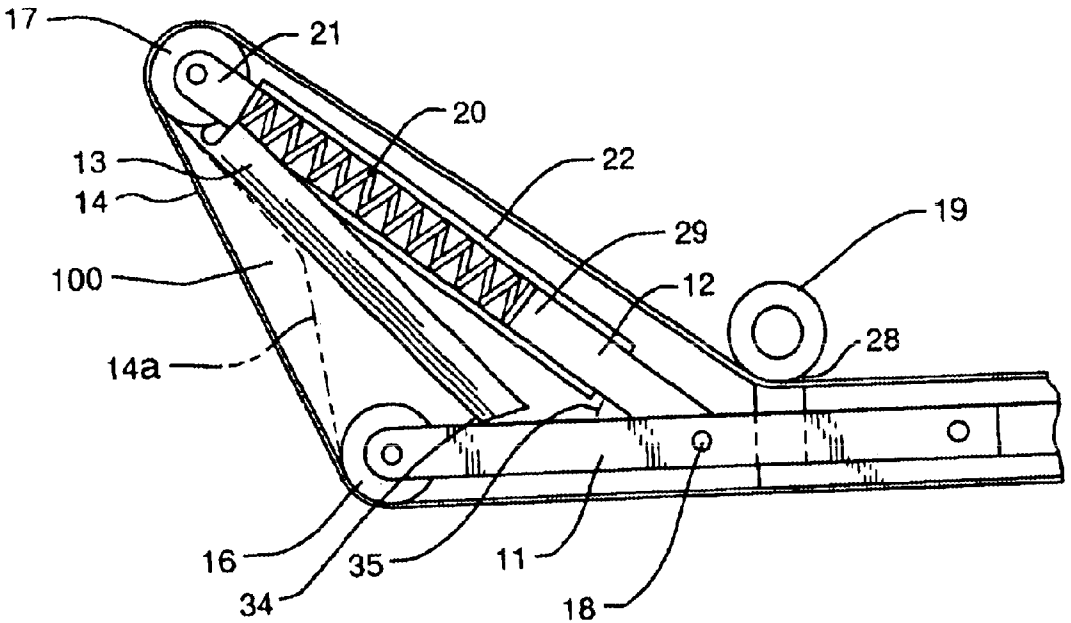
FIG. 3 is a side view of the preferred embodiment of the contour sanding apparatus of the present invention showing the primary arm and secondary arm spread apart without the support shelf deployed, in a configuration for working on an arcuate work piece.

Referring first to FIGS. 1–3, the preferred embodiment of the contour sanding apparatus 10 is shown. This preferred apparatus 10 is similar to the contour sanding apparatus 10 of the Applicant's co-pending U.S. patent application Ser. No. 09/589,507, filed on Jun. 7, 2000, in that the apparatus 10 includes a drive pulley 15, a primary arm 11, and a secondary arm 12. However, a number of improvements have been made to provide greater versatility.

Figure 10:
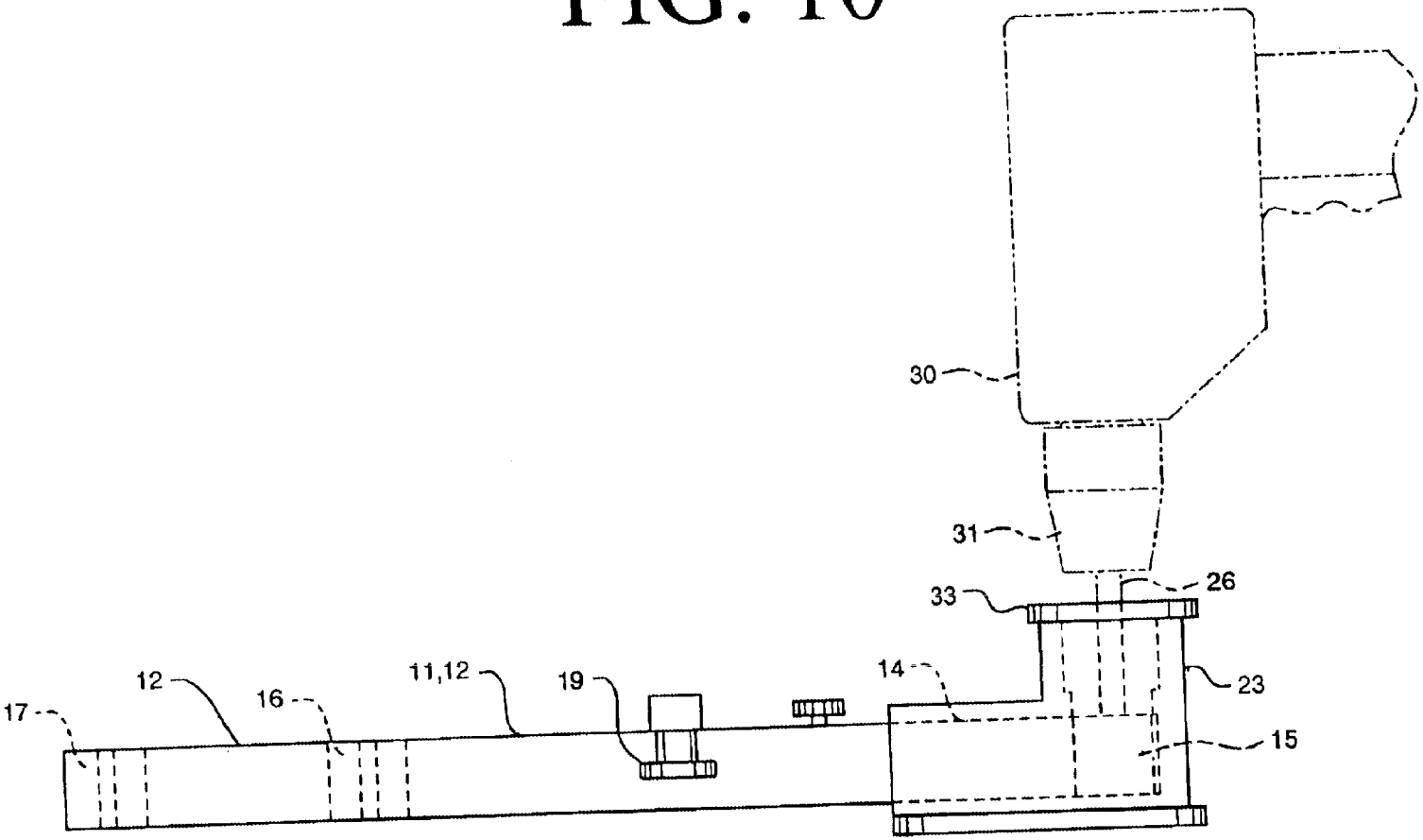
FIG. 10 is a plan view that shows the preferred embodiment of the contour sanding apparatus of the present invention coupled to a representative power drill.

As shown in FIG. 1, the contour sanding apparatus device 10 includes a body 23 that houses a drive-pulley 15. It is the drive-pulley 15 that provides the motive force to a standing belt 14 when the device 10 is in use. The motive force causing the drive-pulley 15 to rotate may come from a drive axle 26 that is coupled to source of rotation. As shown in FIG. 10, the drive axle 26 may rotatably mounted in, and supported by, the body 23 by means of a bearing assembly 32, and the source of rotation may be a chuck 31 of a power tool 30, such as a drill, grinder or the like. However, it is recognized that other means for driving the drive-pulley 15, would be readily recognized by those of ordinary skill in the art.

When the apparatus 10 is in operation, the sanding belt 14 is driven by the drive-pulley 15 and follows a path defined by the belt-support 100, which extends laterally from the body 23. As shown in FIGS. 1–3, the belt-support 100 is a compound entity including a primary-arm 11 and a secondary-arm 12. In some embodiments, this belt support 100 also includes one of a variety of support attachments 13 that are disposed between the primary arm 11 and secondary arm 12. In FIG. 1, the second end 34 of the support attachment 13 is shown as a free end, which is rotated away from the sanding belt. However, as described in detail with reference to FIGS. 4–8, the second end 34 is dimensioned for attachment to the end of the primary-arm 11.

The support attachments 13 may be used to support the sanding portion 14*a* of the sanding belt 14, which is the portion that passes over the belt-support 100 between the primary arm 11 and secondary arm. By varying the angular relationships between the elements of the belt-support 100, and/or adding various support attachments 13, the sanding portion 14*a* of the sanding belt 14 may be made to conform to a broad diversity of contours. Such diversity is a significant advantage of the present invention over the traditional art.

The preferred primary arm 11 is fixedly mounted to the body 23 and includes a primary-arm idler-pulley 16, which is rotatably attached at its second end, and a central slot (not shown) disposed within in the central portion of the primary arm 11. The preferred secondary-arm 12 is disposed within, and pivotally connected to, the central slot in the primary-arm 11 at one end via a pivot pin 18. The other end of the preferred secondary-arm 12 includes a secondary-arm idler-pulley 17, which is rotatably attached to the end. The primary-arm idler pulley 16 and the secondary-arm idler-pulley 17 facilitate the passage of the sanding belt 14 around its path.

In some embodiments, a retainment pulley 19 is disposed at the end of a retainment-arm 28 to further direct the sanding belt 14 to remain on the desired path. The retainment-arm 28 is preferably pivotally connected to the primary-arm 11 between the pivot-pin 18 and the body 23. Such pivotal connection is preferred as it prevents the retainment pulley 19 from exerting too much additional tension upon the sanding belt. However, this pivotal connection is eliminated in other embodiments.

In order to maintain tension on the sanding belt 14, the secondary-arm 12 preferably includes a tensioning means, such as the compression spring 20 shown in FIG. 2. In the preferred embodiment, the secondary-arm 12 is divided into a slidable section 21 and a non-slidable section 29. In this embodiment, the tensioning means includes a spring 20 that is disposed inside of the slidable section 21 and exerts an axial force upon the non-slidable section 29. In this manner, the total length of the secondary-arm 12 varies, depending on the configuration of the device 10 and, in particular, on the configuration of the belt-support 100 relative to the part to be sanded. As the sanding belt 14 travels around the drive-pulley 15, the primary-arm idler-pulley 16, the secondary-arm idler-pulley 17, the spring 20 extends an axial force upon the slidable section 21 against the resistance of the sanding belt 14, thus maintaining tension in the sanding belt 14.

As shown in FIG. 2, the preferred secondary arm 12 also includes a sleeve 22, which constrains the spring 20 and the slidable section 21 to move in a direction coaxial to the longitudinal axis of the non-slidable section 29. However, in other embodiments, the sleeve 22 is eliminated and the non-slidable section 29 is dimensioned to constrain the tensioning means. Further, in some embodiments, the tensioning means is not a spring, but rather is a fluid cylinder, such as a hydraulic or pneumatic cylinder. In such embodiments, it is preferred that the cylinder includes a connection to a source of pressurized fluid in order to allow the tension upon the belt to be controlled.

FIG. 2 shows an embodiment of the apparatus 10 in which the support attachment 13 is a substantially rigid support shelf 13 having a planar work area extends and is locked into place between the distal ends of the primary-arm 11 and secondary arm 12. In this configuration, belt-support 100 forms a triangle over which the sanding belt 14 runs when the apparatus is in use. This provides a flat, relatively stable face with which to sand the work-piece (not shown), and allows the user to exert a greater force on the power tool, and consequently on the work-piece, than would be possible without the support attachment 13. However, any one of the three sides of the triangular shape, around which the belt 14 rotates, can be used to sand or grind the work-piece. In addition, it is recognized that the rigid support shelf 13 need not be planar and may be formed with a rigid support surface having a desired contour. Finally, as described with reference to FIGS. 6–8, the support attachment 13 may be a flex plate attachment 13 that is capable of flexing to form a wide variety of contours.

FIG. 3 shows one embodiment of the apparatus 10 in which the secondary-arm 12 is further lifted away from the primary-arm 11, with an inter-arm angle 35 being determined by the degree to which the support attachment 13, here a rigid support shelf 13, is unfolded from the secondary-arm 12. In such an embodiment, the frictional contact between the distal end of the support shelf 13 and the inside of the primary arm 11 establishes the magnitude of the inter-arm angle 35.

As shown in FIG. 3, to efficiently sand or grind a convex contour of a work-piece using the preferred apparatus, the support attachment 13 is either partially unfolded, as shown in FIG. 3, or is eliminated. This permits the secondary-arm 12 to move angularly in relation to the primary-arm 11, thereby allowing the inter-arm angle 35 to vary. When a convex work-piece 36 is pushed against the belt 14, the sanding portion 14*a* of the belt moves to a deflected position within the inter-arm section, defined by the primary-arm 11 and the secondary-arm 12. The belt 14, being under the tension inducted by spring 20 and the retainment-arm pulley 19, conforms to the general contour of the work-piece 36, allowing the contour to be effectively sanded.

Figure 4:
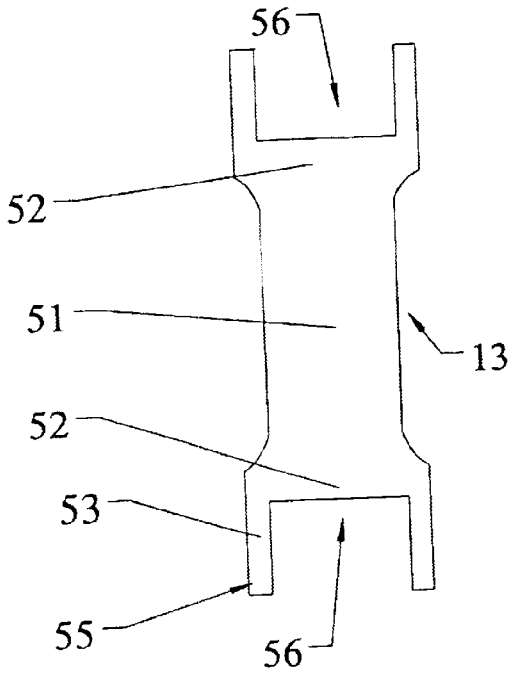
FIG. 4 is a front view of the preferred flex plate attachment.
Figure 5:
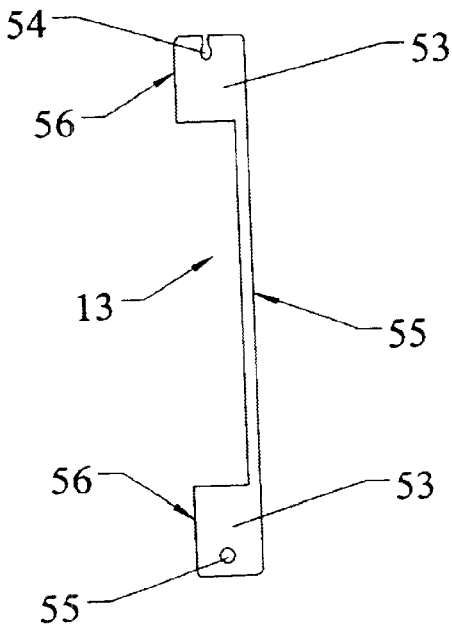
FIG. 5 is a side view of the flex plate attachment.

Referring first to FIGS. 4 and 5, a flex plate attachment 13 for use as a support attachment is shown. The flex plate attachment 13 includes a flexible, bendable region that forms a work area 51. The flexible work area 51 extends between a lower and upper support areas 52, which conformably connect the flexible work area 51 and attaching frames 53. The attaching frames 53 are dimensioned to attach to a variety of different mounts and preferably extend out beyond support areas 52 to leave an open area 56 between the mounting details 54, 55.

The flexible work area 51 of the flex plate attachment 13 may be made of a variety of materials. In light duty applications, such as for use in light duty applications, polycarbonate is the preferred material for the flex plate attachment 13. This material is preferred as it has the characteristics needed to obtain the required flex and strength, yet still be able to build up a spring load as it bends and forms. In addition, this material may be manufactured to present no sharp edges, nor will it wear into sharp edges, that may cause harm to unskilled users, such as homeowners, who may purchase a light duty sander having such a flex plate.

In heavy-duty applications, such as those to be used in industry, the flex plate attachment 13 would preferably be made of spring steel. This material is preferred as it will wear longer than polycarbonate and may be used at higher speeds and temperatures than the light duty flex plate attachment. Further, the individuals exposed to industrial duty belt sanders will be more trained and experienced as opposed to the individuals exposed to the light duty flex plate attached on a light duty belt sander.

Although the above materials are preferred, it is recognized that the flex plate attachment may be manufactured of any material that is flexible enough to form a plurality of arcs without breaking or plastically deforming. For example, hard rubber or other spring metals are utilized in other embodiments. Therefore, the flex plate attachment 13 should not be seen as being limited to the preferred materials, or their equivalents.

In some applications, wear pads (not shown) may be utilized to assist in controlling the wearing of the flex plate attachment 13, and may help control the amount of force or drag created by the rotating and abrading belt. One material used to make suitable wear pads is polytetraflouroethene, either in sheet form, or as a film adhered directly onto the flex plates. However, in other embodiments, the flex plate attachment 13 may itself be coated with a wear resistant material, such as polytetraflouroethene, to provide the same advantages as wear pads.

As shown in FIGS. 4 and 5, the mounting details 54, 55 on the attaching frames are snapping details 54 and pinning details 55. However, due to the fact that there are a large variety of means for that may be used for attachment, the flex plate attachment 13 may include mounting details 54, 55 that function in a different way from the pivotal snapping details 54 and pinning details 55 of FIGS. 4 and 5. For example, in some embodiments, the mounting details 54, 55 are dimensioned for attachment to a slide mount (not shown), such as an upper slide mount and/or a lower slide mount of a conventional bench mounted belt sander. In others, the mounting details 54, 55 incorporate retainment pulleys. Further, it is recognized that many embodiments will include all of a single type of mounting detail, rather than two different details. Therefore, it should be understood that other art recognized means for attaching frames to mounts may be utilized to achieve similar results.

The length of the flexible work area may be varied to allow plurality of arcs to be formed, with short work areas allowing the user to sand small diameter profiles and long work areas allowing large diameter profiles to be sanded. For example, it has been found that a flex plate attachment 13 having length of a one and one half inches will allow a concave surface having a radius of 0.25 inches to be sanded, while one having a five inch length will allow a concave surface having a radius of three inches to be sanded. Accordingly, it is preferred that a number of flex plate attachments 13, each having flexible work areas of varying lengths, be kept on-hand for use with a contour sanding attachment.

Figure 6:
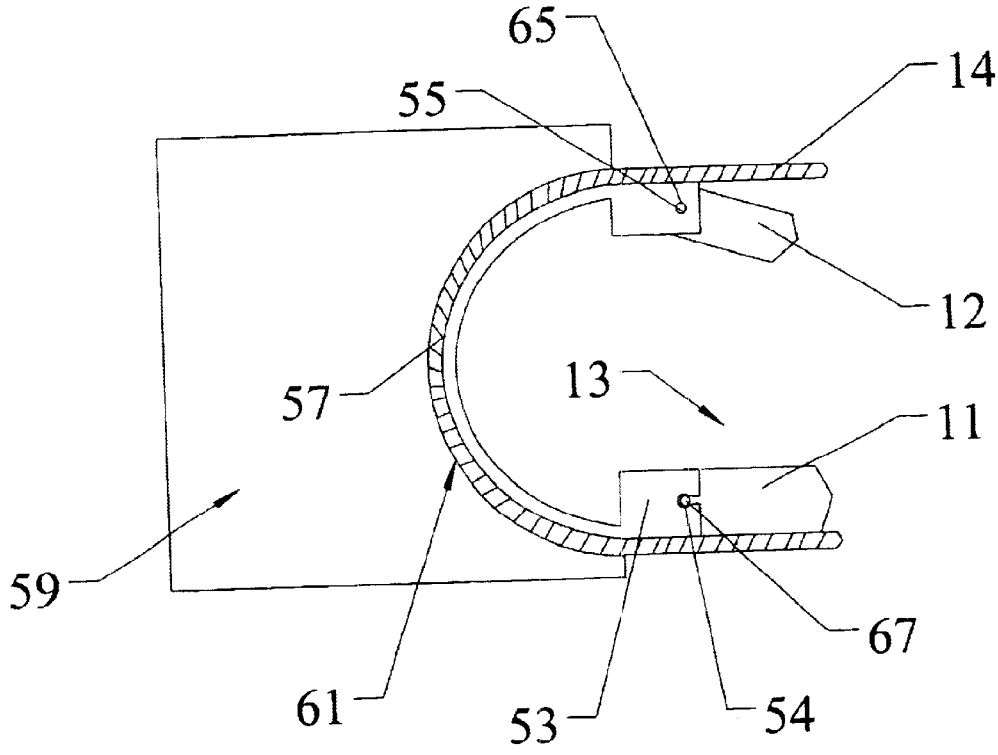
FIG. 6 is a side view of the flex plate attachment attached to the contour sanding apparatus and engaged in a working concave position.

FIG. 6 shows the preferred flex plate attachment 13 engaging a sanding belt 14 with a workpiece 59 to sand a concave profile 61. The preferred flex plate attachment 13 is attached to the primary arm 11 and secondary arm 12 of the contour sanding apparatus 10 via a pair of pins 65, 67, which rotatably engage the mounting details 54, 55 of the attaching frames 53. The sanding belt 14 passes over, and substantially conforms to, the outer surface 57 of the flexible work area 51 and is driven by the belt sander (not shown).

As shown in FIG. 6, the attaching frames 53 extend over the sides of the primary arm 11 and secondary arm 12 and are dimensioned to allow a first pin 65 to pass through the both pinning details 55 on one side of attaching frame 53 and be secured such that the attaching frame 53 may rotate about the first pin 65. The other end of the attaching frame 53 is dimensioned to allow both snapping details 54 to spread to allow entry of the second pin 67 and to capture the second pin 67 such that the attaching frame 53 may rotate about the second pin 67. Although it cannot be seen in FIG. 3, it is noted that the open area 56 between the sides of the attaching frame 53 is dimensioned to provide enough area to avoid interference with the ends of the primary arm 11 and secondary arm 12, while allowing clearance for maneuverability of the flex plate.

In the preferred embodiment, the sanding belt 14 is brought into contact with the workpiece 59 and pressure is exerted to cause the flexible work area 51 to bend to conform to the concave profile 61 of the workpiece 59. The sanding belt 14 is then caused to rotate, effectively sanding the concave profile 61. When pressure is removed, the flexible work area 51 remains in belt contact, but returns to its original, slightly concave, position.

Figure 7:
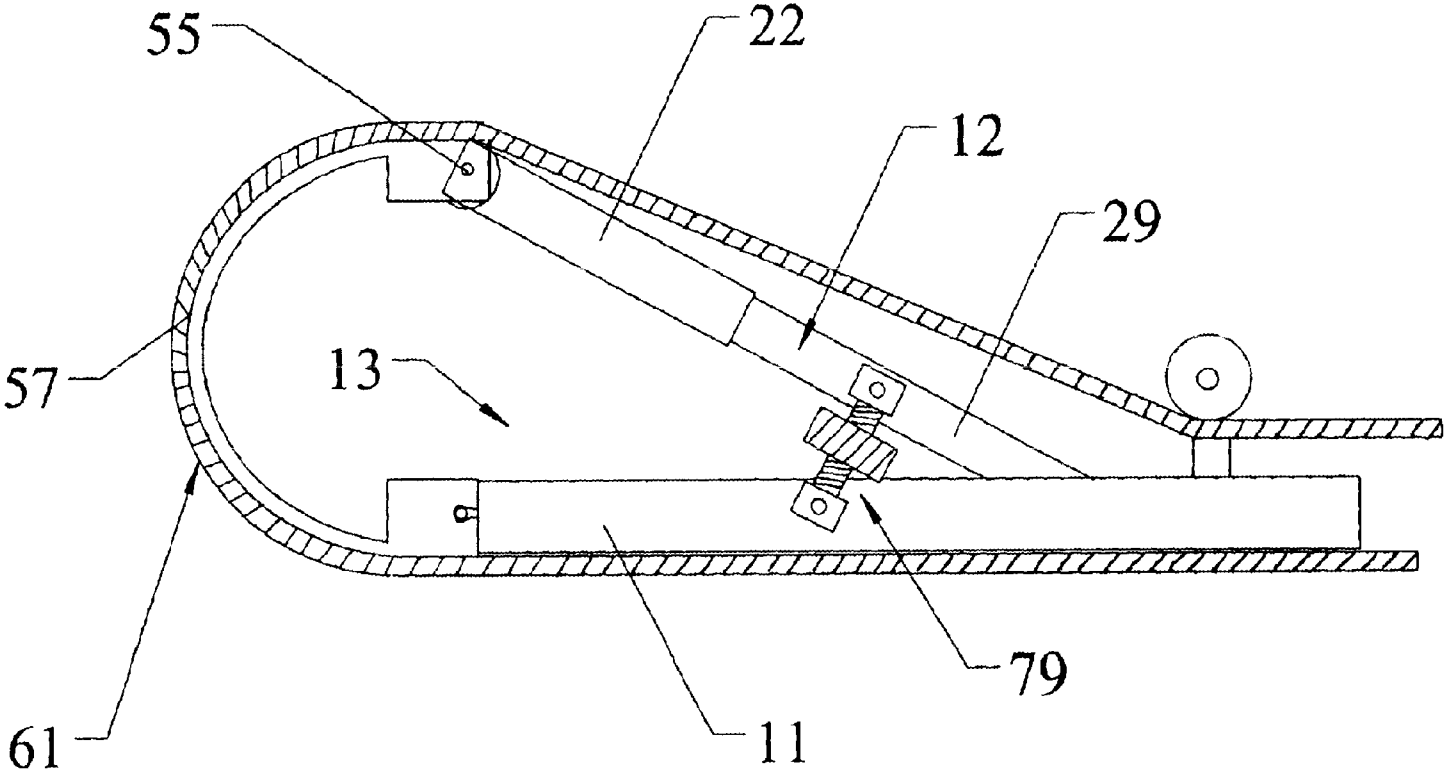
FIG. 7 is a side view of the contour sanding apparatus and sanding portion of the sanding belt showing a flex plate attachment and one embodiment of a locking means for locking the secondary arm in place relative to the primary arm.

In some embodiments, the arc formed by the flexible work area 51 may be set and locked into place with a desired profile without contacting the workpiece. In this manner, the desired profile may be abraded onto workpiece 59 having a different profile. As shown in FIG. 7, one way of accomplishing this is to provide a locking means 79 disposed between the primary arm 11 and secondary arm 12, which allows the angle formed by the arms 11, 12 to be adjusted and held in a fixed position. In FIG. 7, this is shown as a thumb screw adjustment. However, it is recognized that other locking means 79, such as pins, clips, fluid cylinders, locking screws, or the like, may be utilized to achieve similar results. Similarly, in other embodiments, the slidable portion 22 of the secondary arm 12 may be locked into place at a desired location relative to the non-slidable portion 29. As was the case with the angular setting, this locking means 79 may be a thumb screw adjustment, pin, clip, fluid cylinder, locking screw, or the like.

Figure 8:
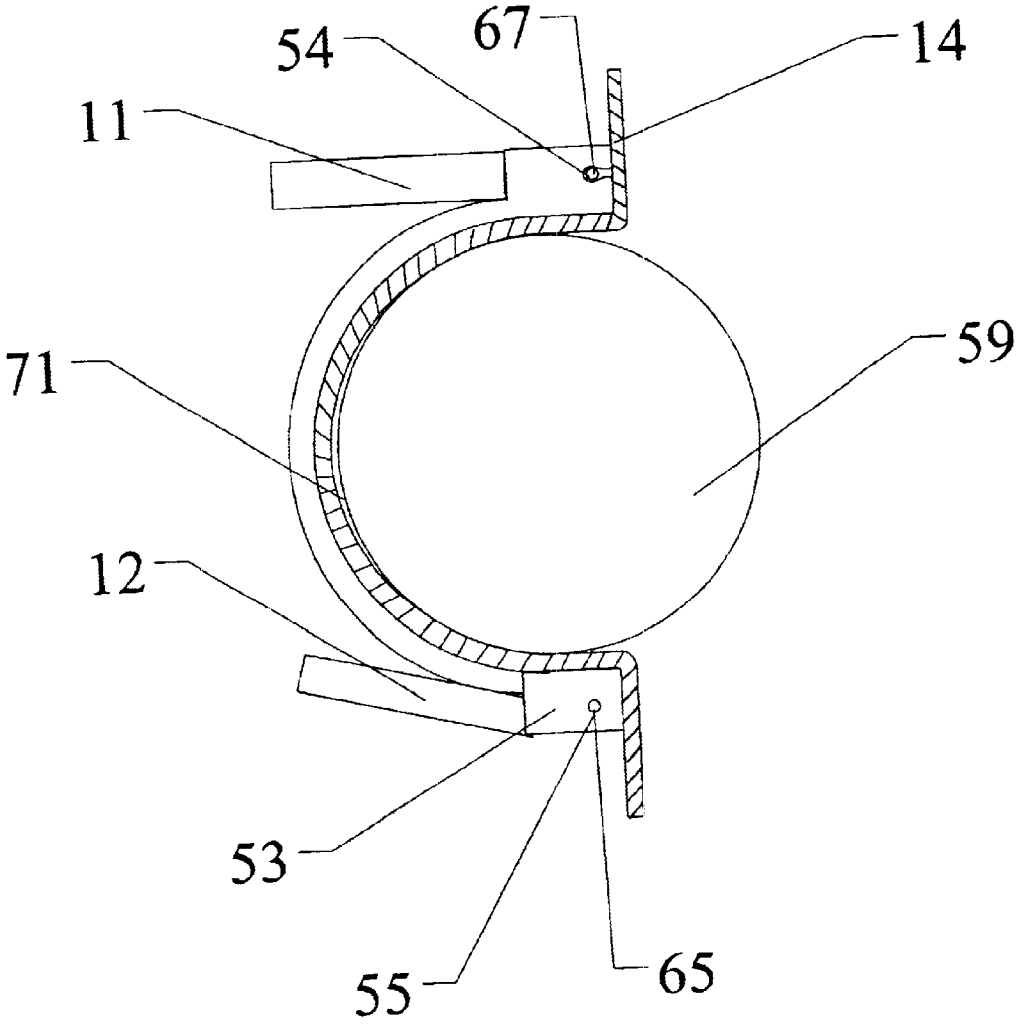
FIG. 8 is a side view of the flex plate attachment attached to the contour sanding apparatus and engaged in a working convex position.

FIG. 8 shows the flex plate attachment 13 engaging a sanding belt 14 with a workpiece 59 to sand a convex profile 71. The flex plate attachment 13 is substantially the same as the flex plate attachment of FIG. 3, except that the outer surface 57 of the flexible work area 51 is caused to form a convex profile. It is noted that, although the flex plate attachment is shown in this arrangement, convex profiles may also be sanded without the aid of any support attachment 13 via the process described with reference to FIG. 3.

Figure 9:
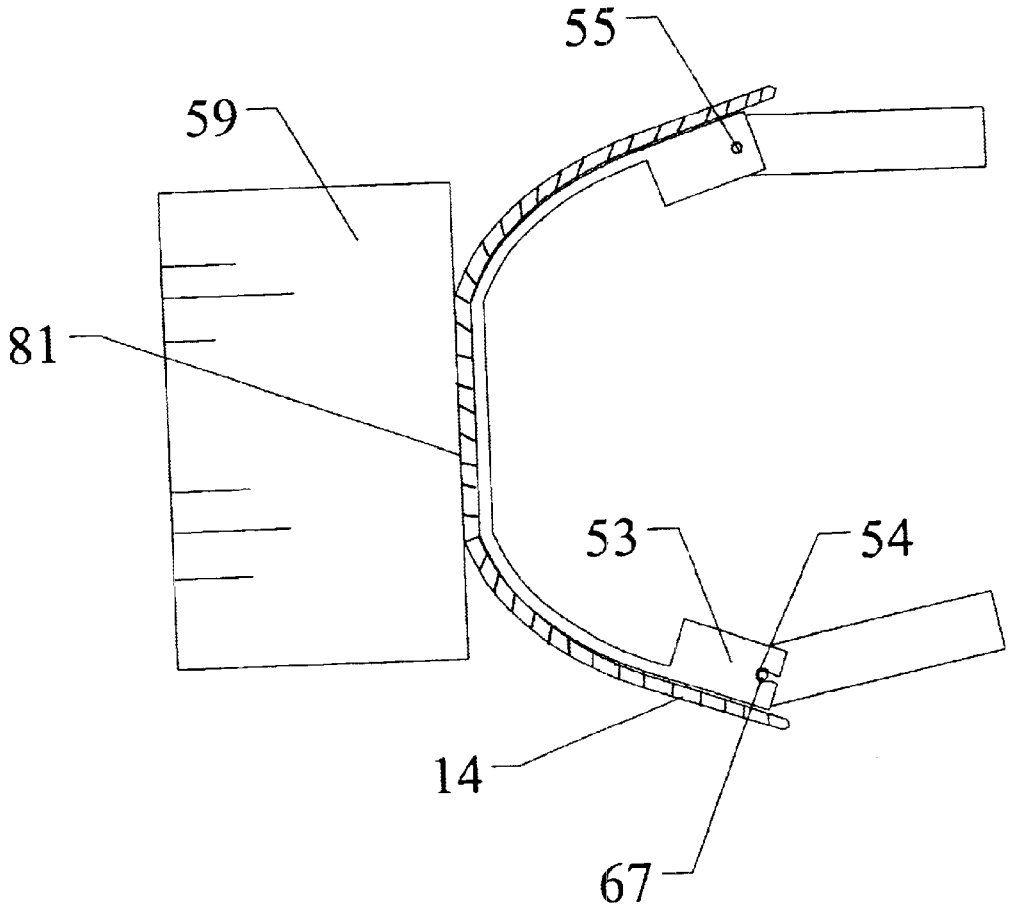
FIG. 9 is a side view of the flex plate attachment attached to the contour sanding apparatus engaged in a working flat position

FIG. 9 shows the preferred flex plate attachment 13 engaging a sanding belt 14 with a workpiece 59 to sand a substantially flat surface 81. Once again it is noted that, although the flex plate attachment is shown in this arrangement, flat surfaces may also be sanded without the aid of any support attachment 13, or with the aid of the substantially rigid support shelf via the process described with reference to FIG. 2.

FIG. 10 shows a plan view of the device 10 coupled to a representative power-drill 30. As coupled, a chuck 31 of the powder-drill 30 is closed about a drive-axle 26 of the contour-sander attachment 10.

Figure 11:
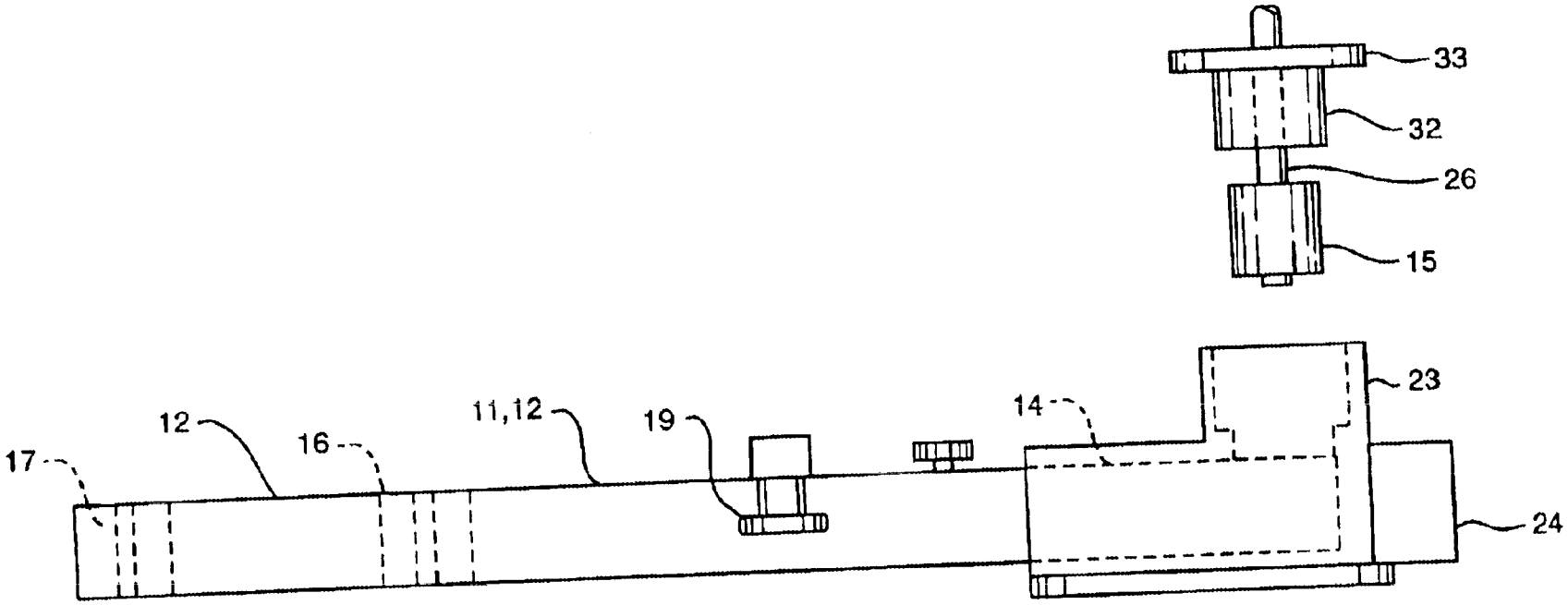
FIG. 11 is an exploded view of the preferred embodiment of the contour sanding apparatus of the present invention.

FIG. 11 shows a partially-exploded view of the device 10, in which the bearing 32 supporting the drive-axle 26 is floating above the body 23. A receiving-cup 33 adapted to enclose the exposed chuck 31 of the power-drill 30 is also depicted. This receiving cup 33 protects the operator of the contour-sander attachment 10 from inadvertent contact with the chuck 31. In such an embodiment the drive-axle 26 is generally shorter than it is shown to be in FIG. 10.

Figure 12:
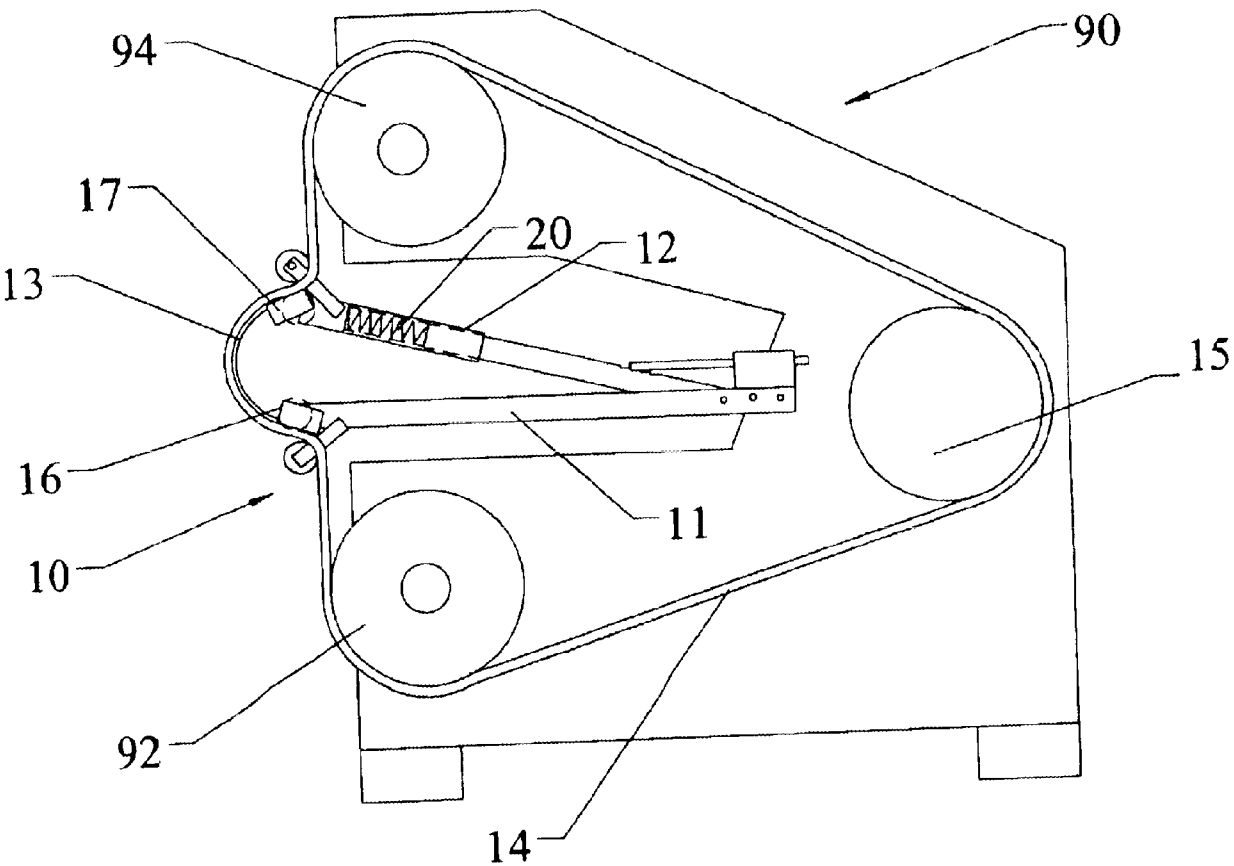
FIG. 12 is a side view of one embodiment of the contour sanding apparatus in which a primary arm, secondary arm and support attachment are added as an attachment to an existing belt sander.

FIG. 12 shows one embodiment of the contour sanding apparatus 10 in which a primary arm 11 and secondary arm 12 are added as an attachment to an existing belt sander 90. As shown in FIG. 12, the primary arm 11 is attached to the belt sander in the triangular area formed by the drive-pulley 15 and the two idler pulleys 92, 94 that are integral to the belt sander. In the embodiment of FIG. 12, a flex plate attachment 13 is attached between the primary arm 11 and secondary arm 12. However, it is recognized that another support attachment 13 may be substituted, or that the flex plate attachment 13 may be eliminated in other embodiments. Likewise, the secondary arm 12 is shown as having a tensioning means including a spring 20. However, in other embodiments the secondary arm 12 is fixed and the belt is tensioned by adjusting the idler pulleys 92, 93 or drive pulley 15 of the belt sander.

Figure 13:
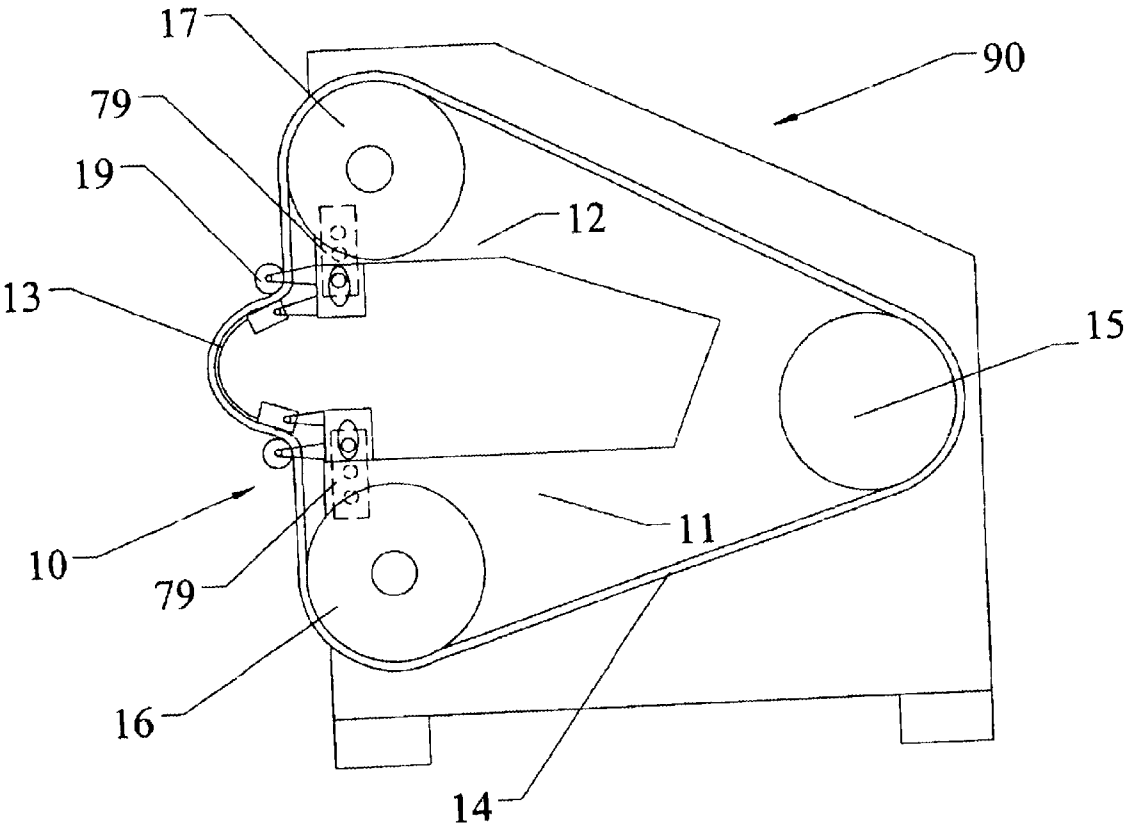
FIG. 13 is side view of one an embodiment of the contour sanding apparatus in which a flex plate attachment is attached between the primary idler pulley and the secondary idler pulley of a conventional bench top belt sander, and in which the primary and secondary arms of the apparatus are integral to the sander.
Figure 14:
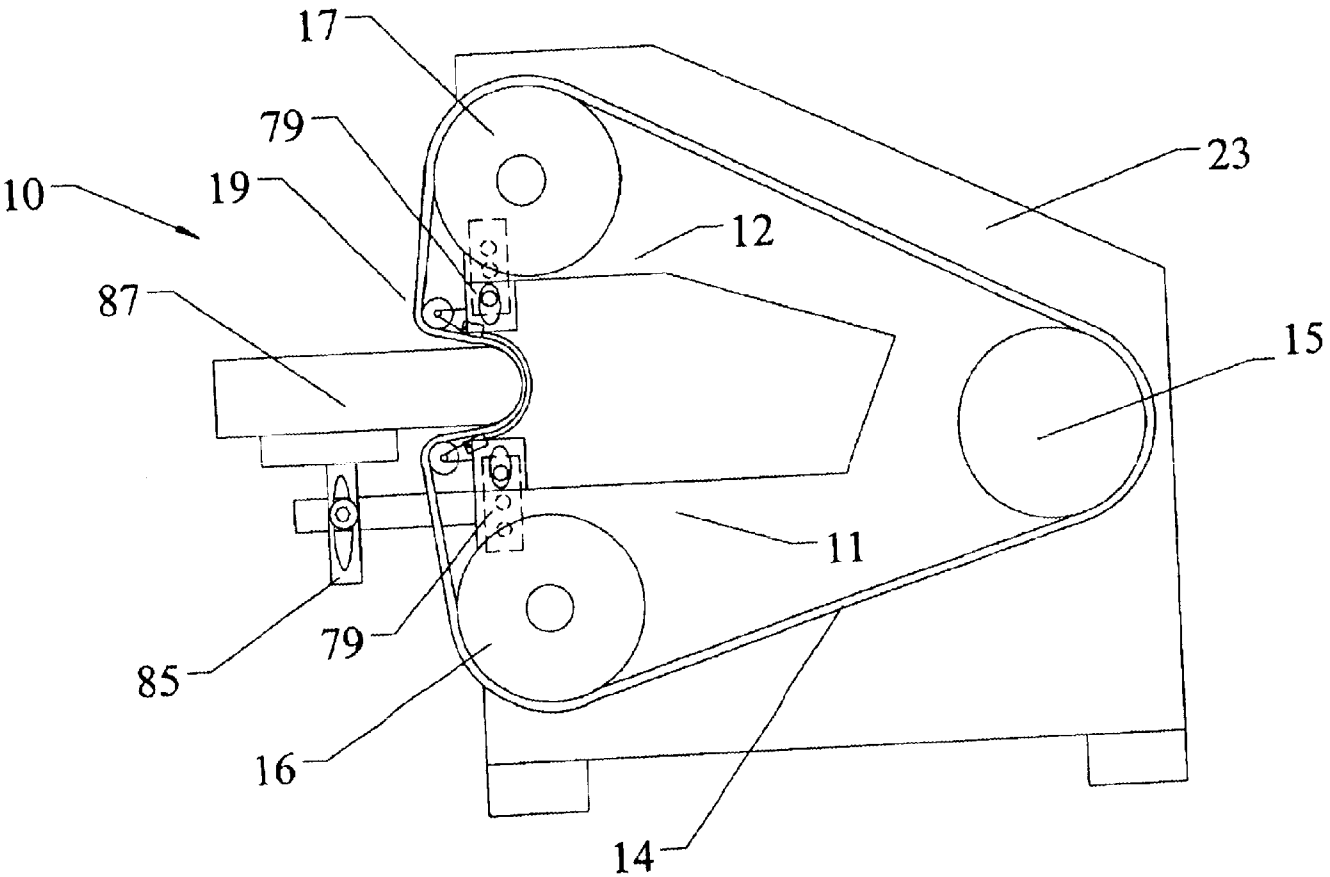
FIG. 14 is side view of another an embodiment of the contour sanding apparatus in which a flex plate attachment is attached between the primary idler pulley and the secondary idler pulley of a conventional bench top belt sander, and in which the primary and secondary arms of the apparatus are integral to the sander.
Figure 15:
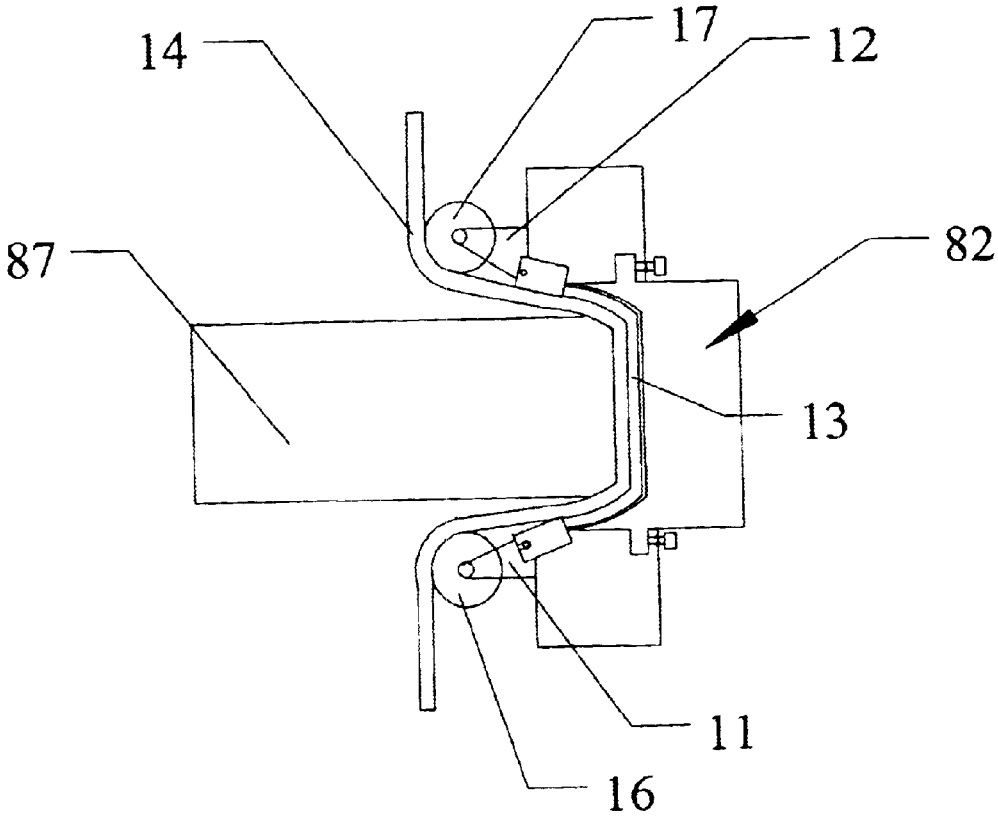
FIG. 15 is side view of still another embodiment of the contour sanding apparatus in which a flex plate attachment is attached between the primary idler pulley and the secondary idler pulley of a conventional bench top belt sander and held to a desired contour by a backer block, and in which the primary and secondary arms of the apparatus are integral to the sander.

FIGS. 13–14 show various embodiments of the invention in which a support attachment 13 is used in connection with a stationary belt sander having a primary arm 11 and secondary arm 12 that are part of the belt sander. In each of these embodiments, the secondary arm 12 is fixed and the belt is tensioned by adjusting the idler pulleys 92, 93 or drive pulley 15 of the belt sander.

FIG. 13 shows an embodiment of the contour sanding apparatus 10 in which a flex plate attachment 13 is attached between the primary idler pulley 16 and the secondary idler pulley 17 of a conventional bench top belt sander. In this arrangement, the flex plate attachment 13 is set to a desired concave contour and held in place by locking means 79. A pair of retainment pulleys 19 guides the sanding belt 14 around the working area of the flex plate attachment to allow a concave contour to be sanded.

FIG. 14 shows another embodiment of the contour sanding apparatus 10 in which a flex plate attachment 13 is attached between the primary idler pulley 16 and the secondary idler pulley 17 of a conventional bench top belt sander. In this arrangement, the flex plate attachment 13 is set to a desired convex contour and held in place by locking means 79. A pair of retainment pulleys 19 guide the sanding belt 14 around the working area of the flex plate attachment to allow a concave contour to be sanded. The embodiment of FIG. 13 also shows a workpiece rest 85 for aligning the workpiece 87 in the proper position for sanding.

FIG. 1 shows another embodiment of the contour sanding apparatus 10 in which a flex plate attachment 13 is attached between the primary idler pulley 16 and the secondary idler pulley 17 of a conventional bench top belt sander. In this embodiment, a flex plate attachment 13 is made to form a desired contour by nesting within a backer block 82. However in other embodiments, the flex plate attachment 13 may be eliminated and a support shelf, having a contour similar to the backer block 82, may be substituted to achieve similar results.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A contour sanding apparatus for driving a sanding belt, said apparatus comprising:

a body;

a drive pulley rotatably attached to said body, said drive pulley comprising a drive-axle dimensioned for attachment to a source of rotation;

a primary arm fixedly attached to said body, said primary arm comprising an end portion to which a primary idler pulley is rotatably attached; and a secondary arm comprising tensioning means for maintaining said sanding belt in tension, and a first end portion to which a secondary idler pulley is rotatably attached, wherein said secondary idler pulley is disposed in relation to said primary idler pulley such that said sanding belt forms a sanding portion between said primary idler pulley and said secondary idler pulley;

wherein said sanding belt is dimensioned for disposal about said drive pulley, said primary idler pulley, and said secondary idler pulley such that said a sanding portion of said sanding belt, disposed between said primary idler pulley and said secondary idler pulley, may be made to conform to a plurality of contours.

2. The contour sanding apparatus as claimed in claim 1 wherein said secondary arm extends from, and is pivotally attached to, said primary arm.

3. The contour sanding apparatus as claimed in claim 2:

wherein said primary arm comprises a central portion having a central slot disposed therethrough; and wherein said secondary arm comprises a second end portion disposed within, and pivotally attached to, said central slot of said primary arm.

4. The contour sanding apparatus as claimed in claim 3:

wherein said secondary arm further comprises a non-slidable section comprising said second end portion, and a slidable section comprising said secondary idler pulley; and wherein said tensioning means comprises a spring disposed between said slidable section and said non-slidable section such that said spring exerts a axial force upon said slidable section relative to said non-slidable section.

5. The contour sanding apparatus as claimed in claim 4 wherein said second arm further comprises a sleeve fixedly attached to said slidable section, said sleeve being slidably disposed about said non-slidable section such that said sleeve and said slidable section may slide along said non-slidable section when acted upon by said axial force exerted by said spring.

6. The contour sanding apparatus as claimed in claim 3 wherein said tensioning means comprises a fluid cylinder having a non-slidable section comprising said second end portion, and a slidable section comprising said secondary idler pulley; and wherein said fluid cylinder further comprises a connection for pressurizing fluid within said fluid cylinder such that an axial force is exerted upon said slidable section relative to said non-slidable section.

7. The contour sanding apparatus as claimed in claim 1 further comprising at least one retainment pulley, said retainment pulley being dimensioned to contact said sanding belt and disposed so as to direct said sanding belt in a desired direction.

8. The contour sanding apparatus as claimed in claim 7 further comprising a retainment-arm to which said retainment-pulley is mounted, said retainment-arm being pivotally connected to said primary arm and disposed such that said retainment pulley directs said sanding belt through a channel in said body.

9. The contour sanding apparatus as claimed in claim 1 further comprising a flex plate attachment disposed between said primary arm and said secondary arm proximate to said primary idler pulley and said secondary idler pulley, said flex plate attachment comprising a lower support area, an upper support area, and a flexible work area that extends between said lower support area and said upper support area.

10. The contour sanding apparatus as claimed in claim 2 further comprising a flex plate attachment disposed between said primary arm and said secondary arm proximate to said primary idler pulley and said secondary idler pulley, said flex plate attachment comprising a lower support area, an upper support area, and a flexible work area that extends between said lower support area and said upper support area.

11. The contour sanding apparatus as claimed in claim 7 further comprising a flex plate attachment disposed between said primary arm and said secondary arm proximate to said primary idler pulley and said secondary idler pulley, said flex plate attachment comprising a lower support area, an upper support area, and a flexible work area that extends between said lower support area and said upper support area.

12. The contour sanding apparatus as claimed in claim 11 wherein said flex plate attachment comprises a lower mounting detail for attaching said flex plate attachment to said primary arm and an upper mounting detail for attaching said flex plate to said secondary arm.

13. The contour sanding apparatus as claimed in claim 10 wherein said flex plate attachment is manufactured of a material selected from a group consisting of polycarbonate, spring steel, and hard rubber.

14. The contour sanding apparatus as claimed in claim 10 wherein said flexible work area of said flex plate attachment is dimensioned to allow said sanding belt to conform to a desired range of contours.

15. The contour sanding apparatus as claimed in claim 10 wherein said flex plate attachment further comprises a wear resistant layer disposed upon said flexible work area.

16. The contour sanding apparatus as claimed in claim 10 further comprising a locking means for securing said secondary arm in a desired position relative to said primary arm.

17. The contour sanding apparatus as claimed in claim 2 further comprising a substantially rigid support shelf, said support shelf being disposed between said primary arm and said secondary arm and proximate to said primary idler pulley and said secondary idler pulley.

18. The contour sanding apparatus as claimed in claim 7 further comprising a substantially rigid support shelf disposed between said primary arm and said secondary arm proximate to said primary idler pulley and said secondary idler pulley.

19. The contour sanding apparatus as claimed in claim 18 wherein said substantially rigid support shelf comprises a rigid work area dimensioned to allow said sanding belt to conform to a desired contour.

20. The contour sanding apparatus as claimed in claim 1 further comprising a source of rotation attached to said drive axle of said drive pulley.

21. The contour sanding apparatus as claimed in claim 1 wherein said drive pulley comprises a drive layer manufactured of a flexible and substantially resilient material.

22. A contour sanding kit comprising:

a contour sanding apparatus for driving a sanding belt, said apparatus comprising:

a drive axle dimensioned for engagement with a source of rotation;

a drive pulley fixedly attached to said drive axle;

a primary arm comprising an end portion to which a primary idler pulley is rotatably attached; and a secondary arm comprising tensioning means for maintaining said sanding belt in tension, and a first end portion to which a secondary idler pulley is rotatably attached, wherein said secondary idler pulley is disposed in relation to said primary idler pulley such that said sanding belt forms a sanding portion between said primary idler pulley and said secondary idler pulley; and at least one support attachment dimensioned for disposal between said primary arm and said secondary arm;

wherein said sanding belt is dimensioned for disposal about said drive pulley, said primary idler pulley, and said secondary idler pulley such that said work area of said support attachment engages a sanding portion of said sanding belt to cause said sanding portion to conform to a plurality of contours.

23. The contour sanding kit as claimed in claim 22 wherein said at least one support attachment comprises at least one flex plate attachment.

24. The contour sanding kit as claimed in claim 23 wherein said flex plate attachment comprises a lower mounting detail for attaching said flex plate attachment to said primary arm of said apparatus and an upper mounting detail for attaching said flex plate to said secondary arm of said apparatus.

25. The contour sanding apparatus as claimed in claim 23 wherein said flex plate attachment further comprises a wear resistant layer disposed upon said flexible work area.

26. A contour sanding apparatus for driving a sanding belt, said apparatus comprising:

a drive axle dimensioned for engagement with a source of rotation;

a drive pulley fixedly attached to said drive axle;

a primary arm comprising an end portion to which a primary idler pulley is rotatably attached;

a secondary arm comprising a first end portion to which a secondary idler pulley is rotatably attached, wherein said secondary idler pulley is disposed in relation to said primary idler pulley such that said sanding belt forms a sanding portion between said primary idler pulley and said secondary idler pulley; and a flex plate attachment disposed between said primary arm and said secondary arm proximate to said primary idler pulley and said secondary idler pulley, said flex plate attachment comprising a lower support area, an upper support area, and a flexible work area that extends between said lower support area and said upper support area;

wherein said sanding belt is dimensioned for disposal about said drive pulley, said primary idler pulley, and said secondary idler pulley such that said flexible work area of said flex plate attachment engages a sanding portion of said sanding belt to cause said sanding portion to conform to a plurality of contours.

27. The contour sanding apparatus as claimed in claim 26 wherein said flex plate attachment comprises a lower mounting detail for attaching said flex plate attachment to said primary arm of said apparatus and an upper mounting detail for attaching said flex plate to said secondary arm of said apparatus.

28. The contour sanding apparatus as claimed in claim 26 wherein said flex plate attachment further comprises a wear resistant layer disposed upon said flexible work area.

* * * * *